US008434339B2

(12) United States Patent
Yogo

(10) Patent No.: US 8,434,339 B2
(45) Date of Patent: May 7, 2013

(54) PRESSING DEVICE FOR BENDING

(75) Inventor: Teruaki Yogo, Seto (JP)

(73) Assignee: Kabushiki Kaisha Opton, Seto-shi (JP)

( * ) Notice: Subject to any disclaimer, the term of this patent is extended or adjusted under 35 U.S.C. 154(b) by 185 days.

(21) Appl. No.: 13/057,403

(22) PCT Filed: Aug. 7, 2009

(86) PCT No.: PCT/JP2009/064032

§ 371 (c)(1),
(2), (4) Date: Feb. 3, 2011

(87) PCT Pub. No.: WO2010/016575

PCT Pub. Date: Feb. 11, 2010

(65) Prior Publication Data

US 2011/0132056 A1 Jun. 9, 2011

(30) Foreign Application Priority Data

Aug. 8, 2008 (JP) ..... 2008-205685

(51) Int. Cl.
*B21D 11/00* (2006.01)
*B21D 9/05* (2006.01)

(52) U.S. Cl.
USPC ..... 72/307; 72/149

(58) Field of Classification Search ..... 72/149, 72/154, 155, 157, 158, 307
See application file for complete search history.

(56) References Cited

U.S. PATENT DOCUMENTS 3,064,711 A * 11/1962 Fuchs, Jr. ..... 72/309
3,287,952 A * 11/1966 Van Harten ..... 72/155
4,038,853 A * 8/1977 Schwarze ..... 72/157
4,727,738 A * 3/1988 Yogo ..... 72/157
4,959,984 A * 10/1990 Trudell et al. ..... 72/154

FOREIGN PATENT DOCUMENTS

| | | | |
|---|---|---|---|
| JP | 6182451 | A | 7/1994 |
| JP | 10-71428 | A | 3/1998 |
| JP | 10071428 | A | 3/1998 |
| JP | 2000-326013 | A | 11/2000 |
| JP | 2000326013 | A | 11/2000 |
| JP | 2002-263738 | A | 9/2002 |
| JP | 2002263738 | A | 9/2002 |

OTHER PUBLICATIONS

PCT International Search Report for PCT/JP2009/064032, Mail date Oct. 27, 2009.
PCT Preliminary Report on Patentability, mailed Mar. 17, 2011, PCT/JP2009/064032.

* cited by examiner

*Primary Examiner* — Teresa M Ekiert
(74) *Attorney, Agent, or Firm* — Mesmer & DeLeault, PLLC

(57) ABSTRACT

The present invention provides a pressing device for bending, in which a pipe is held between a bending die having a shape corresponding to a shape of bending and a clamping die revolvable around the bending die, and, when the pipe is bent by revolving the clamping die around the bending die, an axial compression force is applied to the pipe. The pressing device for bending includes a movable table arranged movable in an axial direction of the pipe, a first cylinder provided to the movable table and able to press a rear end of the pipe, and a second cylinder provided to the movable table and able to press a fixed side in a direction opposite to a direction in which the first cylinder presses the pipe.

2 Claims, 4 Drawing Sheets

PRESSING DEVICE FOR BENDING

TECHNICAL FIELD

The present invention relates to a pressing device for bending, which applies an axial compression force to a pipe when winding the pipe around a bending die to bend the pipe.

BACKGROUND ART

In a conventional known bending device such as described in Patent Document 1, bending of a pipe is performed while an axial compression force is applied to the pipe, in order to avoid local thinning of a wall of the pipe upon bending.

In such a device, a chuck which holds an end of the pipe is mounted on a carriage. The carriage is moved in an axial direction of the pipe via a chain by a motor. The device is also provided with a driving cylinder that presses and moves a rack. Upon bending, the carriage and the rack are connected via a gear so that an axial compression force is applied to the pipe upon bending.

Patent Document 1: Japanese Unexamined Patent Application Publication No. 06-182451

DISCLOSURE OF THE INVENTION

Problems to be Solved by the Invention

Such a conventional device involves the following problem: Since the carriage is moved by the motor while an axial compression force is applied by the driving cylinder and the rack, the device becomes complex in structure and large in size.

One object of the present invention is to provide a pressing device for bending, which is simple in structure and small in size.

Means for Solving the Problems

In order to attain the above object, the present invention has taken the following measures to solve the problem. The present invention provides a pressing device for bending, in which a pipe is held between a bending die having a shape corresponding to a shape of bending and a clamping die revolvable around the bending die, and, when the pipe is bent by revolving the clamping die around the bending die, an axial compression force is applied to the pipe. The pressing device for bending includes: a movable table arranged movable in an axial direction of the pipe; a first cylinder provided to the movable table and able to press a rear end of the pipe; and a second cylinder provided to the movable table and able to press a fixed side in a direction opposite to a direction in which the first cylinder presses the pipe.

Two first cylinders may be arranged interposing an axial center of the pipe, while two second cylinders may be arranged interposing the axial center of the pipe and alternating with the first cylinders. Also, the first cylinder may be configured to press the rear end of the pipe via a hollow pressing shaft.

Effect of the Invention

In the pressing device for bending according to the present invention, the movable table is provided with the first cylinder able to press the rear end of the pipe, and the second cylinder able to press the fixed side in the direction opposite to the direction in which the first cylinder presses the pipe. Therefore, there are effects that an axial compression force can be applied to the pipe and that the pressing device for bending is simple in structure and small in size.

EXPLANATION OF REFERENCE NUMERALS

| | | | |
|---|---|---|---|
| 1 | bending die | | |
| 1a, 1b, 1c | bending groove | 2 | pipe |
| 4 | clamping die | 6 | pressure die |
| 8 | bending mechanism | 10 | device body |
| 12 | elevating/lowering table | | |
| 14 | right/left movable table | | |
| 14a | standing wall | 16 | guide rail |
| 18 | movable table | 18a | front wall |
| 18b | rear wall | 20, 22 | second cylinder |
| 24, 26 | first cylinder | 28 | pressure plate |
| 30 | pressing shaft | 32 | hollow shaft |
| 34 | guide member | 36 | mandrel shaft |
| 38 | mandrel | 40 | support plate |
| 42, 44 | mandrel cylinder | 46 | robot |

BEST MODE FOR CARRYING OUT THE INVENTION

Hereinafter, a detailed description will be provided on a best mode for carrying out the present invention, with reference to the drawings.

Figure 1:
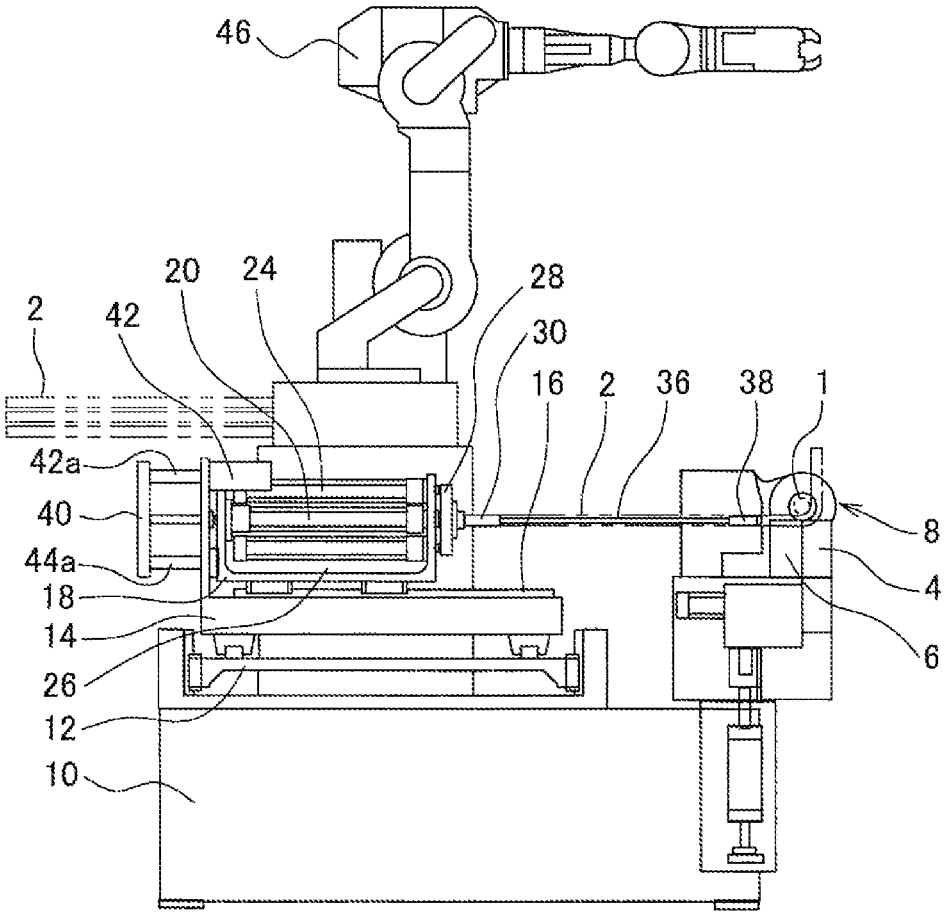
FIG. 1 is a front view of a bending device which uses a pressing device for bending as one embodiment of the present invention.

As shown in FIG. 1, reference numeral 1 denotes a bending die. The bending die 1 has a shape corresponding to a shape of bending. A clamping die 4 is arranged to face the bending die 1. A pressure die 6 is arranged in line with the clamping die 4.

Figure 2A:
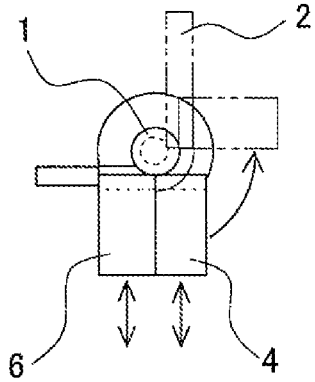
FIGS. 2A and 2B are explanatory views of a bending mechanism of the present embodiment.
Figure 2B:
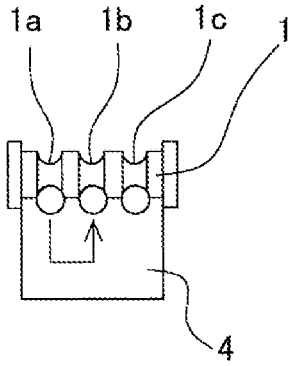

In the present embodiment, the bending die 1 is arranged so that its axial direction is horizontal, as shown in FIG. 2A. The bending die 1 is provided with bending grooves 1*a*, 1*b* and 1*c*, having shapes corresponding to a plurality of shapes of bending, at predetermined intervals in the axial direction, as shown in FIG. 2B. The clamping die 4 is moved toward the bending die 1, while driven to revolve around the bending die 1. In this manner, the pipe 2 is bent to shapes corresponding to the bending grooves 1*a*, 1*b* and 1*c*.

The pressure die 6 is configured to be moved toward the bending die 1 and pressed against the pipe 2 upon bending so as to be able to receive a reaction force upon bending. The bending die 1, the clamping die 4 and the pressure die 6 constitute a bending mechanism 8. The bending mechanism 8 is supported by a device body 10.

As shown in FIG. 1, an elevating/lowering table 12 is supported by the device body 10 in a manner able to be elevated/lowered in a direction orthogonal to the axial direction of the bending die 1. The elevating/lowering table 12 is driven to be elevated/lowered by a not shown drive source such as a hydraulic cylinder. On the elevating/lowering table 12, a right/left movable table 14 is supported in a manner movable in a direction along the axial direction of the bending die 1. The right/left movable table 14 is moved to the right/left by a not shown drive source such as a hydraulic cylinder.

Figure 3:
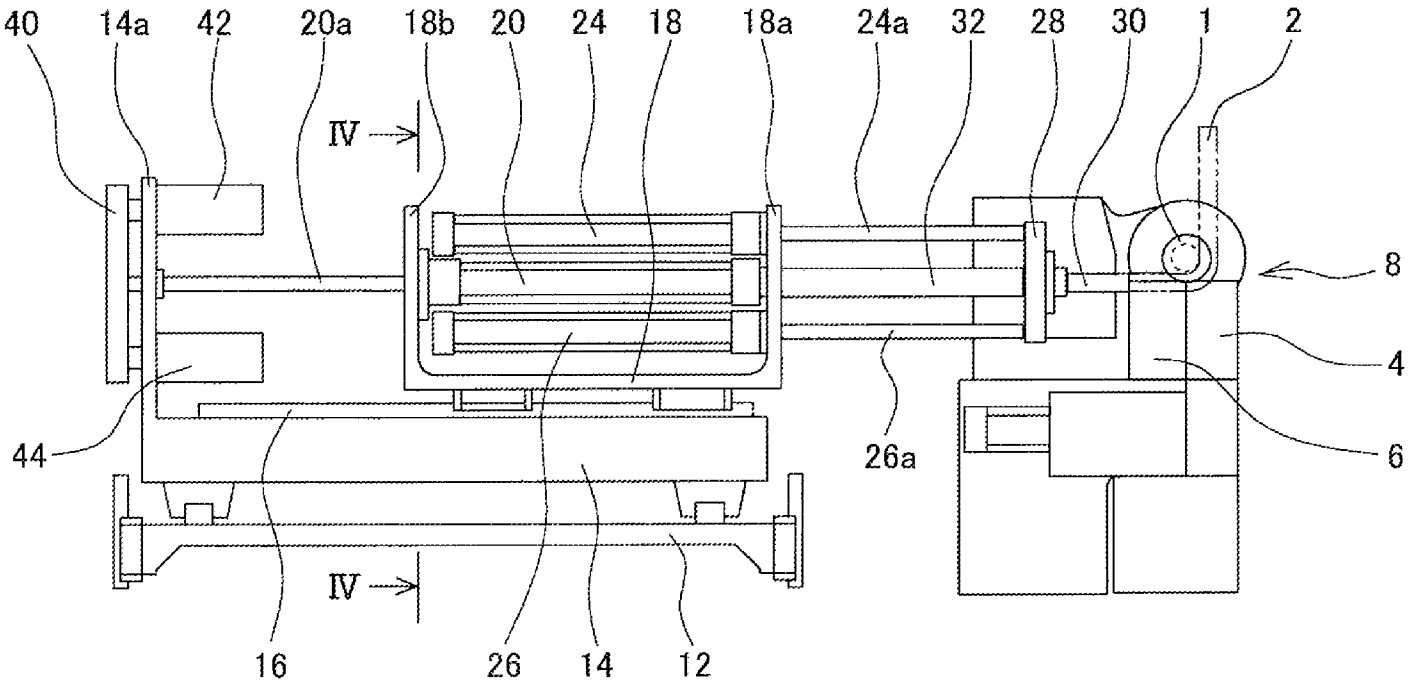
FIG. 3 is an enlarged front view of the pressing device for bending of the present embodiment.
Figure 4:
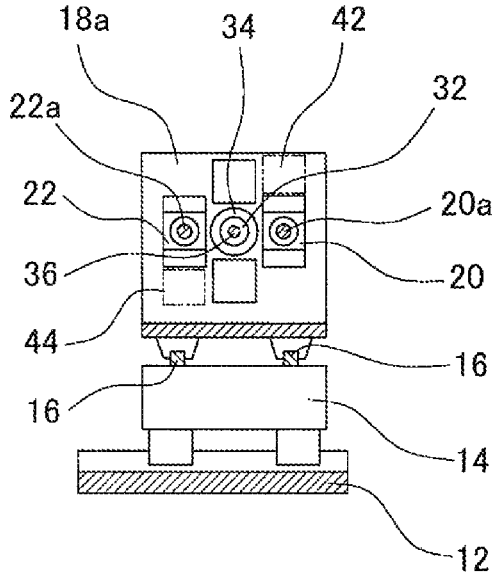
FIG. 4 is a cross sectional view taken along lines IV-IV in FIG. 3.

As shown in FIGS. 1 and 3, the movable table 18 is supported in a manner movable in the direction orthogonal to the axial direction of the bending die 1 along a guide rail 16 laid on the right/left movable table 14. The movable table 18 is provided with a front wall 18*a* orthogonal to its moving direction and a rear wall 18*b* provided at a predetermined interval in parallel to the front wall 18*a*.

Two first cylinders 24 and 26 are provided in the front wall 18*a* in parallel to the moving direction of the movable table 18. Rods 24*a* and 26*a* of the two first cylinders 24 and 26 protrude toward the bending die 1. A pressure plate 28 is secured to front ends of the rods 24*a* and 26*a*.

In the right/left movable table 14, a standing wall 14*a* is provided in parallel to the rear wall 18*b*. In the rear wall 18*b*, the two second cylinders 20 and 22 are provided in parallel to the moving direction of the movable table 18. Rods 20*a* and 22*a* of the two second cylinders 20 and 22 protrude to a side opposite to the bending die 1. Front ends of the rods 20*a* and 22*a* are secured to the standing wall 14*a* as a fixed side.

The two first cylinders 24 and 26 are arranged on both sides above and below the pipe 2 so as to interpose an axial center of the pipe 2. The two second cylinders 20 and 22 are arranged on both right and left sides of the pipe 2 so as to interpose the axial center of the pipe 2, and to alternate with the first cylinders 24 and 26. With such arrangements, the movable table 18 can be downsized.

A pressing shaft 30 which protrudes toward the bending die 1 is attached to the pressure plate 28. The pressing shaft 30 is formed to be substantially the same as the pipe 2 in outer diameter. Also, the pressing shaft 30 is hollowed and is substantially the same as the pipe 2 in inner diameter as well. The pressing shaft 30 is arranged coaxial to the pipe 2 upon bending. A front end of the pressing shaft 30 is formed in a manner able to abut on an end of the pipe 2.

One end of a hollow shaft 32 which protrudes toward the front wall 18*a* is secured to the pressure plate 28, coaxially with the pressing shaft 30. The hollow shaft 32 penetrates the front wall 18*a* and is slidably inserted to a guide member 34 attached to the front wall 18*a*.

A mandrel shaft 36 is arranged coaxial to the pressing shaft 30 and the hollow shaft 32 (see FIG. 1). A mandrel 38 is attached to a front end of the mandrel shaft 36 on a side of the bending die 1. The mandrel 38 is arranged closer to the bending die 1 than the pressing shaft 30. The mandrel shaft 36 is arranged to pass through the pressing shaft 30 and further through the hollow shaft 32 and penetrates the rear wall 18*b*.

A rear end of the mandrel shaft 36 penetrates the standing wall 14*a* to protrude rearward from the standing wall 14*a*, and secured to a support plate 40 parallel to the standing wall 14*a*. Two mandrel cylinders 42 and 44 are attached to the standing wall 14*a*. Front ends of rods 42*a* and 44*a* of the two mandrel cylinders 42 and 44 are secured to the support plate 40. The mandrel shaft 36, the mandrel 38, the support plate 40 and the mandrel cylinders 42 and 44 may be provided as required.

A robot 46 is mounted on the device body 10. The robot 46 is configured to be set the pipe 2, which is stocked in a not shown stocker, to the bending mechanism 8.

Now, a description will be provided on an operation of the pressing device for bending in the above embodiment.

First, the pipe 2 is set to the bending mechanism 8 in a state where the mandrel 38 is inserted to the pipe 2. Then, the clamping die 4 is moved toward the pipe 2 to hold the pipe 2 between the bending die 1 and the clamping die 4. The pressure die 6 is also moved to abut on the pipe 2. Further, the mandrel cylinders 42 and 44 are driven to move the mandrel 38 to a predetermined bending position via the support plate 40 and the mandrel shaft 36.

Moreover, from a state shown in FIG. 1, the two second cylinders 20 and 22 are driven, for example, to move the movable table 18 along the guide rail 16 toward the bending die 1. In doing so, the front end of the pressure shaft 30 hits the rear end of the pipe 2 to press the pipe 2.

Then, by revolving the clamping die 4 around the bending die 1, the pipe 2 is bent at a bending radius corresponding to the shape of the bending die 1. In this case, the two second cylinders 20 and 22 are simultaneously driven to press the rear end of the pipe 2 via the pressing shaft 30, so that bending is performed while an axial compression force is applied to the pipe 2. Thereby, even if the bending radius is as small as a radius of the pipe 2, local thinning of the pipe 2 can be avoided.

Upon further bending the pipe 2, the clamping die 4 is returned to its original position. Then, by driving the two second cylinders 20 and 22 to press the rear end of the pipe 2 via the pressing shaft 30, the pipe 2 is pushed out to be moved to a predetermined bending position. If a stroke by the two second cylinders 20 and 22 is not sufficient, the two first cylinders 24 and 26 are driven to move the pressing shaft 30 via the pressure plate 28. In this case, the hollow shaft 32 is guided by the guide member 34 to horizontally move the pressure plate 28.

Then, by revolving the clamping die 4 around the bending die 1, the pipe 2 is bent at the bending radius corresponding to the shape of the bending die 1. Simultaneously, the two first cylinders 24 and 26 are driven to press the rear end of the pipe 2 via the pressing shaft 30, so that bending is performed while an axial compression force is applied to the pipe 2. Also, as shown in FIG. 3, by pushing with the pressing shaft 30, the pipe 2 can be bent up to a vicinity of its rear end.

As noted above, by providing the two first cylinders 24 and 26 in the front wall 18*a* of the movable table 18, and the two second cylinders 20 and 22 in the rear wall 18*b*, to protrude in opposite directions, the device can be downsized.

In a case where bending is performed at a different bending radius, for example, in a case where a bending with the bending groove 1*a* is changed to a bending with the bending groove 1*b*, the elevating/lowering table 12 is lowered to move the right/left movable table 14 in accordance with a position of the bending groove 1*b*. Thereafter, the elevating/lowering table 12 is elevated again. Thereby, the pipe 2 can be moved to the position corresponding to the bending groove 1*b*. The elevating/lowering table 12 and the right/left movable table 14 may be provided as required.

The present invention described above is not limited to such an embodiment, but may be practiced in various forms within the scope not departing from the spirit of the present invention.

What is claimed is:

1. A pressing device for bending, in which a pipe is held between a bending die having a shape corresponding to a shape of bending and a clamping die revolvable around the bending die, and, when the pipe is bent by revolving the clamping die around the bending die, an axial compression force is applied to the pipe, the pressing device comprising:

a fixed portion of a standing wall;

a movable table arranged movable in an axial direction of the pipe with respect to the fixed portion;

at least two first cylinders provided on the movable table and able to press a rear end of the pipe; and at least two second cylinders provided to the movable table and able to press the fixed portion in a direction opposite to a direction in which the first cylinder presses the pipe wherein the at least two first cylinders are arranged to interpose an axial center of the pipe while the at least two second cylinders are arranged to interpose the axial center of the pipe and to alternate with the at least two first cylinders.

2. The pressing device for bending according to claim 1, wherein the first cylinder is configured to press the rear end of the pipe via a hollow pressing shaft.

* * * * *